US005807121A

United States Patent [19]

Fulop et al.

[11] Patent Number: 5,807,121

[45] Date of Patent: Sep. 15, 1998

[54] JUNCTION COMPONENT FOR CONNECTING THE ELECTRICAL LEADS OF A PRINTED CIRCUIT BOARD AND A SEPARATE ELECTRICAL UNIT

[75] Inventors: Jozsef Fulop; Ferenc Papp; Jozsef Tokes; Istvan Wursching, all of Budapest, Hungary; Kelvin B. Belle, South Euclid, Ohio; Leon F. Chamberlain, Palm Springs, Calif.; David J. Kachmarik, North Olmsted, Ohio; Brian M. Ronald, Salt Lake City, Utah

[73] Assignee: General Electric Company, Schenectady, N.Y.

[21] Appl. No.: 707,899

[22] Filed: Sep. 12, 1996

Related U.S. Application Data

[63] Continuation of Ser. No. 646,173, May 7, 1996, abandoned.

[51] Int. Cl.[6] ..... H01R 9/09

[52] U.S. Cl. ..... 439/82; 439/947; 439/83

[58] Field of Search ..... 439/81, 82, 84, 439/78, 395, 947, 83; 174/267

[56] References Cited

U.S. PATENT DOCUMENTS

| | | | |
|---|---|---|---|
| 2,209,734 | 7/1940 | Larkin | 439/683 |
| 3,147,060 | 9/1964 | Jensen et al. | 439/683 |
| 4,261,629 | 4/1981 | Reynolds et al. | 439/82 |
| 4,836,792 | 6/1989 | Glover | 439/81 |
| 4,909,754 | 3/1990 | Paradis | 439/405 |
| 4,979,903 | 12/1990 | Gosselis | 439/78 |
| 5,618,187 | 4/1997 | Goto | 439/79 |

FOREIGN PATENT DOCUMENTS 88116587.2 10/1988 European Pat. Off. .

*Primary Examiner*—Gary F. Paumen
*Assistant Examiner*—Barry M. L. Standig
*Attorney, Agent, or Firm*—George E. Hawranko; Fay, Sharpe, Beall, Fagan, Minnich & McKee

[57] ABSTRACT

A junction component fixed on a PCB (13) has a slot (4) suitable for accepting the electrical leads (10) protruding from the electrical unit and also has a base part (11) and a connection part (12). The base part (11) is embedded into the PCB (13) and is connected with its corresponding output. The leads of the electrical unit are connected to a connection part (12). At the place of connection, the orientation of the electrical leads is substantially perpendicular to the plane of the PCB (13). The direction in which the electrical leads are connected to the connection part (12) is substantially parallel to the plane of the PCB (13). The base part (11) comprises a base plate (1) and tabs(s) (8*a*–8*c*) bending out from it. The tab(s) protrude(s) into openings (17) formed in the PCB (13) and is (are) embedded there in a way also ensuring electrical contact to the PCB (13). The base plate (1) connects the tab(s) (8*a*–8*c*) with the connection part (12), and the connection part (12) is made to have an orientation substantially in or parallel to the plane of the base plate (1).

11 Claims, 2 Drawing Sheets

JUNCTION COMPONENT FOR CONNECTING THE ELECTRICAL LEADS OF A PRINTED CIRCUIT BOARD AND A SEPARATE ELECTRICAL UNIT

This is a continuation of application Ser. No. 08/646,173, filed May 7, 1996, abandoned.

BACKGROUND OF THE INVENTION

This invention relates to an electrically conducting junction component for connecting the electrical leads of a printed circuit board (hereinafter PCB) and a separate electrical unit. The junction component according to the invention may be used with advantage particularly in light sources, e.g. in discharge lamps including compact fluorescent lamps integral with an electronic ballast. The electrical unit in this case is represented by the discharge tube.

To assemble the discharge tubes integral with an electronic ballast, the electric conductors coming from the electrodes have to be connected with the terminals of the ballast, i.e. of the PCB. As it is known, one electrode is placed at each end of a discharge tube and the electric arc works between these electrodes. The electrical inleads of the electrodes have to be connected with the electronic unit, i.e. with the corresponding terminals of the PCB. The task of the ballast is to start and to maintain the electric arc in the discharge tube. The electronic components necessary for operating the discharge tube or at least most of them are placed on the PCB in a way known in itself.

Earlier, the electrical connection was performed by aligning each electric conductor protruding from the discharge tube to the end of the corresponding lead protruding from the PCB, and pressing a piece of copper plate (copper ribbon) onto the ends of these connecting leads. The electrical connection was provided by these pressed sleeves. This solution, however, has disadvantages in several respects: to embed the connection leads into the PCB is a relatively complicated task; to perform the operation of pressing requires additional equipment and is labor-consuming; finally, these leads have to be placed inside the shell belonging to the discharge tube which, in addition to the troublesome process, can cause various kinds of short circuit.

Recently, another solution has become known in which metal tubes with longitudinally slotted mantles are built in the PCB as electrical connection components. These tubes protrude from the board and the slots extend to the tube ends. The lead end protruding from the discharge tube is pressed into this slot, which results in the lead's getting stuck or jammed in the slot. Due to the damaged surface of the lead, the coating of oxide layer of the lead will be broken. In this way, an electrical connection comes into being which is maintained by the mechanical joint ensured by the jam (friction). Although the complicated operation of pressing the copper plate is not used in this solution, positioning the leads of the discharge tube to the corresponding slotted tubes cannot be avoided. This is caused by the off-positioned leads protruding from the discharge tube. These leads are not in line with the slotted tubes, therefore the discharge tube cannot be aligned with a PCB of fixed position. The slotted tubes can only be connected to the leads of the discharge tube if the PCB is placed outside the line of the discharge tube. For this operation, the PCB must be positioned, which requires a separate machine. To make the electrical connection, the leads must be pressed into the slotted tubes being outside the position needed for the mechanical connection. The slotted tubes are fixed to the PCB with soldering. This joint is rather sensitive and can easily be damaged as it is exposed to mechanical load during connecting the lead and the PCB to each other, a fact leading to the shortening of its life as a final result.

SUMMARY OF THE INVENTION

The objective of the invention was to provide a junction component for connecting a PCB and a separate electrical unit, which, when making the connection between these, does not expose the place of electrical connection on the PCB to mechanical load.

The invention is based on the recognition that the sensitive part of the junction component can be relieved of mechanical load by such a junction component which has a slot for accepting the electrical lead of the electrical unit and which is provided with component parts, e.g. tabs bent out from its own plate material, supported by the rim of the PCB so that the load appearing during inserting the lead into the slot acts on the said tabs.

Based on the above recognition, the objective set was, according to the invention, achieved by means of a junction component for connecting the electrical leads of a PCB and a separate electrical unit, which electrically conducting junction component is fixed on the PCB and has a slot suitable for accepting the leads protruding from the electrical unit. This junction component is composed of a base part and a connection part, of which the base part is embedded in the PCB and is connected with the corresponding output of the printed circuit, and the electrical leads of the electrical unit are connected to the connection part of the junction component with the orientation of the electrical leads being, where the connection is made, substantially perpendicular to the plane of the PCB. This junction component is characterized in that the direction in which the electrical lead is connected to the connection part is substantially parallel to the plane of the PCB, the base part is composed of a base plate and tab(s) bent out from it, which tab(s) protrudes (protrude) into hole(s) formed in the PCB, and is (are) embedded into it in a way providing electrical contact also with the PCB, the base plate joins the tab(s) with the connection part, and the connection part is formed so that its plane is substantially the same as or parallel to the plane of the base plate. Preferably, the connection part is placed at or adjacent to the edge of the PCB and the tab(s) passes (pass) through the PCB and is (are) fixed to it by means of soldering. In another embodiment, slots increasing the resilience of the connection part are formed in the base plate, adjacent to the connection part. According to another feature of the invention, the junction component has also a clamping arm that protrudes from the plane of its base plate.

The invention also relates to a junction component for connecting a PCB and a separate electrical unit which electrically conducting junction component is fixed on the PCB and has a slot suitable for accepting the lead protruding from the electrical unit. This junction component consists of a base part and a connection part, of which the base part is embedded in the PCB and is connected with the corresponding output of the printed circuit, and the electrical leads of the electrical unit are connected to the connection part with the orientation of the electrical leads being, where the connection is made, substantially perpendicular to the plane of the PCB. This junction component is characterized in that the connection part is represented by a clamping fork having resilient prongs, and protruding from the base plate of the base part and the prongs of the clamping fork are placed in substantially parallel direction to the PCB, and a slot is provided between them for accepting an electrical lead, the direction of which is substantially perpendicular to the PCB. It is advantageous when the clamping fork protrudes beyond the PCB at its edge and a cutout is provided in the PCB around the slot of the clamping fork. According to a further feature of the invention, the end portion of the slot for introducing the electric lead is formed as an outwardly broadening space bordered by slant guiding surfaces. The inner end of the slot can preferably continue in a broadening hole. In another embodiment, notches narrowing the prongs of the clamping fork and increasing resilience are made on the outer side of the prongs of the clamping fork, adjacent to the base plate.

BRIEF DESCRIPTION OF THE DRAWINGS

In what follows, the invention will be described in details based on the attached drawings illustrating preferred embodiments of the junction component and some possible ways of its connection with a PCB. In the drawings.

DESCRIPTION OF THE PREFERRED EMBODIMENTS(S)

Figure 1:
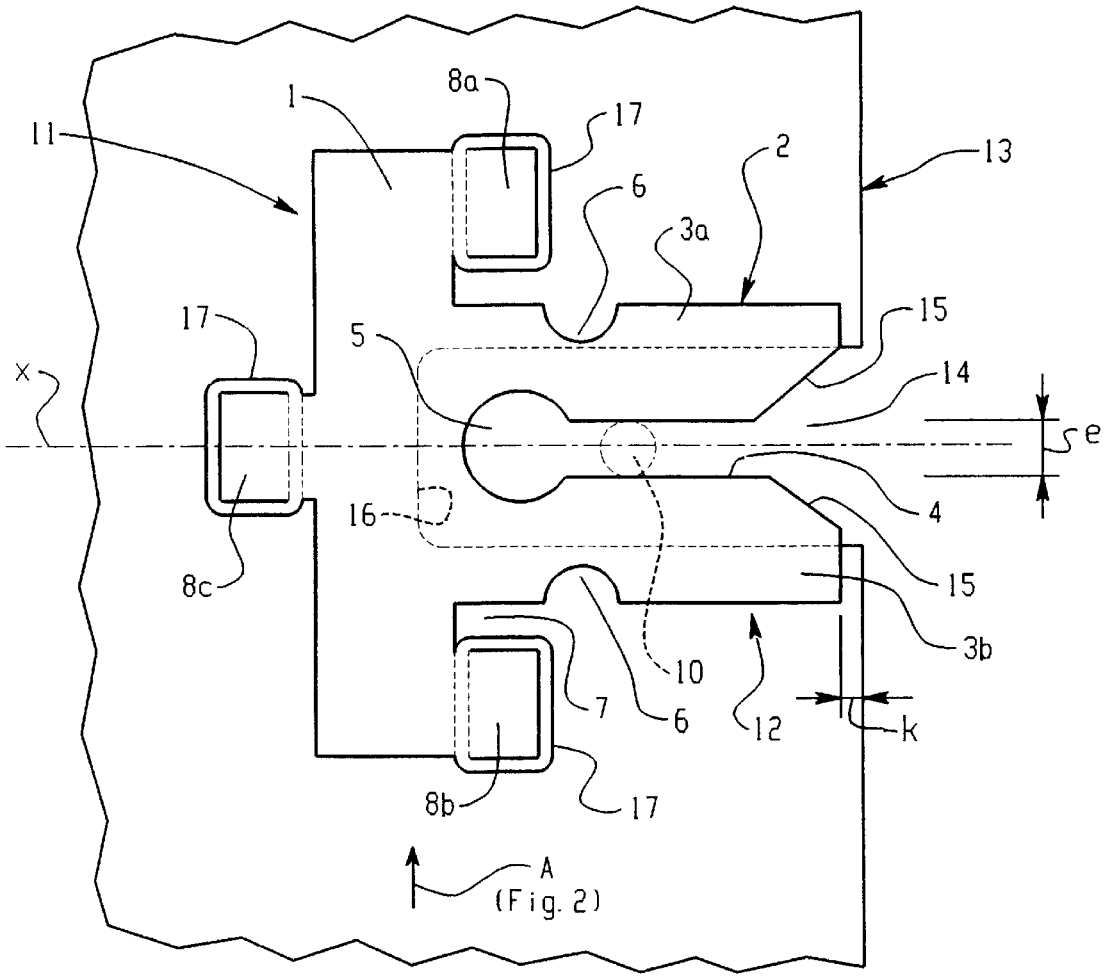
FIG. 1 shows an embodiment of the junction component according to the invention where the junction component is built in the PCB; this embodiment is shown in a view perpendicular to the plane of the PCB.
Figure 2:
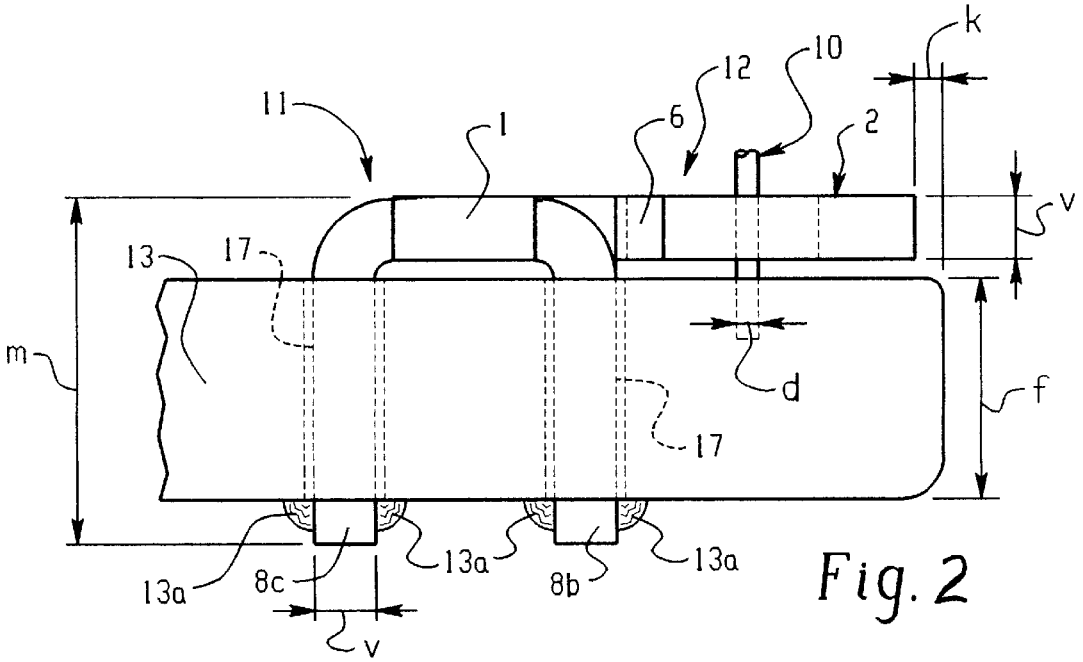
FIG. 2 is the view from the arrow A indicated in FIG. 1.

The junction component shown in FIGS. 1 and 2, which may be made by means of slitting and cutting operations, has a base part 11 and a connection part 12. The material of the junction component is a metal plate. The base part 11 is in connection with PCB 13 shown partly in FIGS. 1 and 2, and the connection part 12 is in connection with an electrical lead 10 being a part of an electrical unit, e.g. a discharge tube (not shown). The end portion of the electrical lead 10 intended to make electrical connection is shown as dashed lines in FIGS. 1 and 2.

In the case of this embodiment, the connection part 12 has a clamping fork 2 which protrudes from and is in the plane of the rectangular base plate 1 of base part 11 and is also perpendicular to the longer side of the rectangle. A slot 4 is placed between the prongs 3*a*, 3*b* of the said clamping fork 2 (FIG. 1). The width e of slot 4 is preferably smaller than the diameter d of the lead 10, and the slot 4 broadens in the region of its outside end. The space 14 having increasing width outwards is bordered by the inner slant guiding surfaces 15 of the prongs 3*a*, 3*b* (FIG. 1). The inner end of the slot 4 leads into hole 5. Semicircular-shaped notches 6 are placed on the outer side of the prongs 3*a*, 3*b*, adjacent to the base plate 1. Starting from these notches 6, slits 7 are placed which increase the resilience of the connection part 12 and protrude into the base plate 1 and are perpendicular to its longitudinal direction. These slits 7 together with the said hole 5 make it easier for the prongs 3*a*, 3*b* of the clamping fork 2 to move apart from each other to a small extent, i.e. to be deformed resiliently, when the lead 10 is pushed into the slot 4 during connecting. Notches 6 play a role primarily in the assembling and manufacturing process.

Tabs 8*a*, 8*b* and 8*c* of the same height m (FIG. 2) starting and bent out in the same direction from and perpendicular to the plane of the base plate 1 of the base part 11 belong to the base part 11. The tabs 8*a* and 8*b* are placed at the opposite sides of the clamping fork 2 at the outer sides of said slits 7. The tab 8*c* is placed in line with the clamping fork 2 but on that side of the base plate 1 which is opposite to the clamping fork 2. As seen in FIG. 1, the junction component is symmetrical to the geometrical center plane X which is perpendicular to the base plate 1 and passes through the slot 4 and is denoted by a dash-dot line. The height m depends on the thickness of the sheet material of the junction component, and it should also fit to the sheet thickness f of the PCB 13 (FIG. 2). This is necessary because the junction component is fixed to the PCB 13 by the tabs 8*a*, 8*b* and 8*c* of the base part 11. Each of the tabs 8*a*, 8*b*, 8*c* being parallel to each other is passed through a through opening 17 formed in the PCB 13, and the ends of the tabs slightly protruding from the PCB 13 are fixed to the PCB 13 by solders 13*a*. In case of the example according to FIGS. 1 and 2, the junction component is countersunk into the PCB 13 in the way that the connection part 12 does not protrude in lateral direction from the PCB 13. However, it is placed above an elongated opening 16 indented into PCB 13 in lateral direction. The edge of the PCB 13 protrudes beyond the end of the clamping fork 2 of connection part 12 slightly, amounting to a spacing k. The construction described results in that when the PCB 13 and the lead 10 of a separate electrical unit, e.g. of a discharge tube (not shown) are pushed together during assembling, the tabs 8*a*–8*c* are exposed to the mechanical loads caused by this assembling operation, and these tabs 8*a*–8*c* are able to take up these loads safely, thereby relieving the components providing for the electrical connection of mechanical loads.

Figure 3:
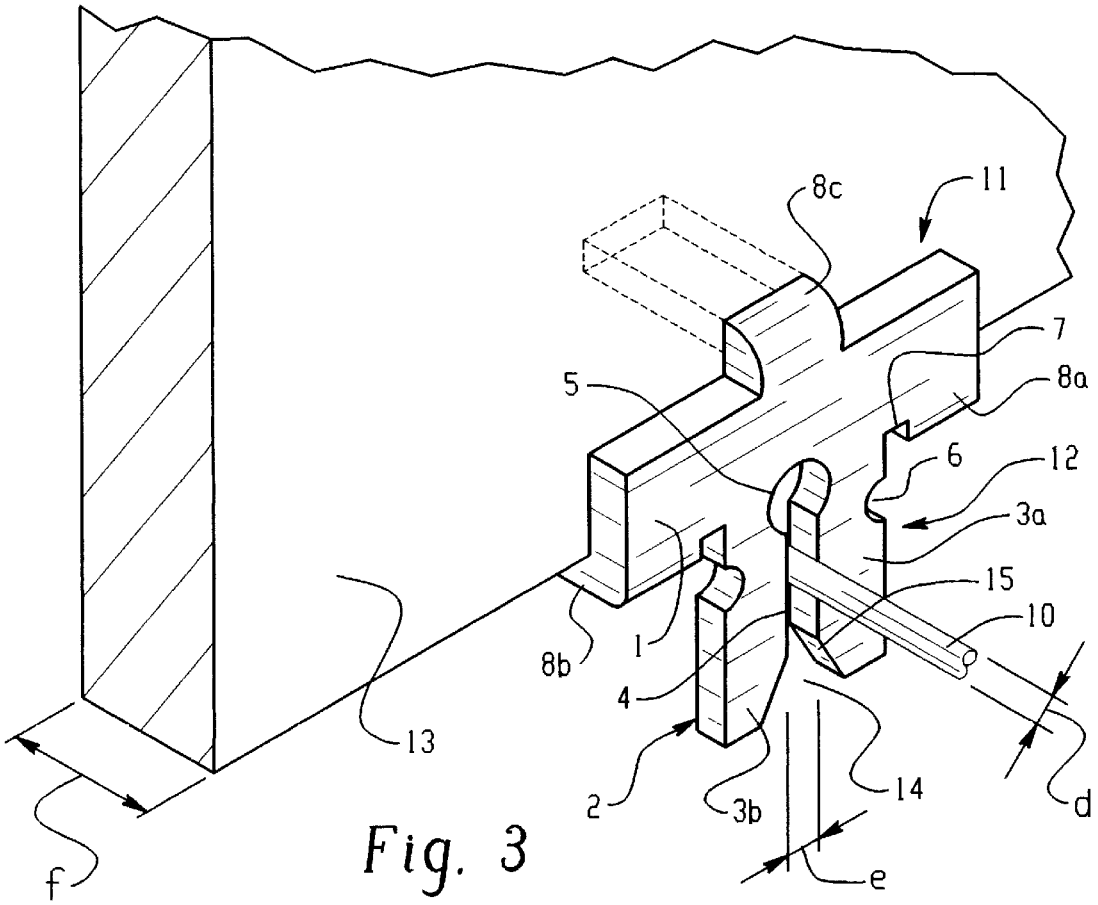
FIG. 3 is an exploded view where a junction component in the construction as that shown in FIG. 1 is illustrated in perspective, built in a position to fit to one of the edges of the PCB.

The embodiment of the junction component seen in FIG. 3 corresponds to that according to FIGS. 1 and 2, therefore the reference numbers of these latter ones are used to denote the identical construction parts. The solution seen in FIG. 3 differs from that illustrated in FIGS. 1 and 2 in that the junction component is not countersunk into the PCB 13, but the clamping fork 2 of the connection part 12 protrudes outwards from the edge of the PCB 13. The base plate 1 of the base part 11 and the damping fork 2 of the connection part 12 are parallel to the plane of the PCB 13 in this case as well. Here, connection of the base part 11 to the PCB 13 is made in the way that only the tab 8*c* is passed through and fixed to the PCB 13 (the opening for this and the solder on the other side of the PCB 13 are not shown in FIG. 3 for better overview), while the tabs 8*a* and 8*b* fit to the edge of the PCB 13. The mechanical loads occurring when the lead 10 is inserted into the slot 4 of the clamping fork 2 are taken up by the tabs 8*a*–8*c* in this case as well.

Figure 4:
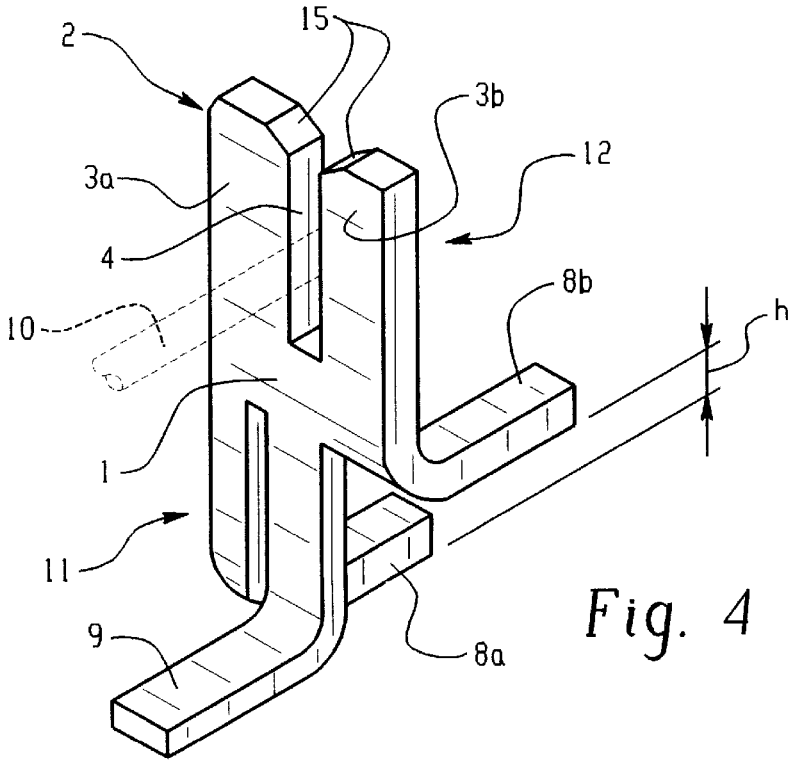
In FIG. 4, another embodiment of the junction component according to the invention is shown also in perspective.

The embodiment of the junction component seen in FIG. 4 differs from those according to FIGS. 1 through 3 as follows: it has only two tabs 8*a*, 8*b* perpendicular to the base plate 1 of the base part 11, which tabs 8*a*, 8*b* protrude from this base plate 1 in one direction and are placed at a spacing h one below or above the other. Also, an arm 9 protrudes in the direction opposite to the tabs 8*a*, 8*b*, which arm 9 is provided for the purposes of the manufacturing process: controlled by the manufacturing program, the junction component is gripped, moved and embedded into the PCB 13 by an automatic equipment (not shown). In FIG. 4, the PCB is not shown and construction components described previously are denoted by the reference numbers already used. Connection of the junction component according to FIG. 4 to the PCB is made in a way similar to that according to FIGS. 1 and 2, i.e. this is a countersunk construction, which means that the end of the clamping fork 2 of the connection part 12 will be, in top view, inside of the edge of the PCB. It is a difference from the solution shown in FIGS. 1 and 2 that only two tabs 8*a*, 8*b* are passed through and soldered to the PCB.

It is an advantage of fundamental importance that the junction component relieves the sensitive and delicate electrical contact points on the PCB of the mechanical loads occurring during the assembly of the PCB with a separate electrical unit, e.g. in manufacturing light sources, such as compact fluorescent lamps, integral with an electronic ballast. This results in the lengthening of lifetime of the product.

A further advantage is that by using the junction component according to the invention the operation of making the electrical contact will be significantly simplified: soldering the leads of the electrical unit or a more complicated contact making is not needed. The operation for making a mechanical (snap-in) joint will automatically ensure that the electrical connection is performed. Assembling can be well automated. The junction component is small-sized, thus requires small room and can be used for operating units of practically any shape, position, number and size. The same junction component can be used for PCBs of different shape, number and position. The electrical connection is of excellent safety (the force needed to maintain the contact is provided by resilient deformation and the direction of electric lead is perpendicular to the printed-circuit board), in addition the possibility to collide with certain mounts will be reduced.

The invention, of course, is not limited to the embodiment of the junction component described in detail previously, but can be implemented in several ways within the scope of protection defined in the claims.

What is claimed is:

1. An electrically conducting junction component fixed on an associated printed circuit board for connecting electrical leads of the printed circuit board and an electrical lead of a separate electrical unit, the junction component comprising:

a base part resiliently fitted in the associated printed circuit board and being connected to the corresponding output of the printed circuit board, the base part including an integral base plate and at least one tab bent outwardly therefrom, the at least one tab protruding into a corresponding hole in the printed circuit board and being resiliently fitted therein to provide electrical contact therewith; and a connection part having two prongs joined to the at least one tab by the base plate and being formed so that its plane is substantially the same as or substantially parallel to the plane of the base plate, the connection part being substantially flat and having a slot in between the two prongs adapted to resiliently fitted receive the electrical lead of the separate electrical unit, thereby breaking up an oxide layer on the surface of the lead, with the orientation of the electrical lead being substantially perpendicular to the plane of the printed circuit board so that the direction in which the electrical lead is connected to the connection part is substantially parallel to the plane of the printed circuit board.

2. The junction component according to claim 1 wherein the connection part is placed at an edge or close to the edge of the printed circuit board.

3. The junction component according to claim 1 wherein the at least one tab is passed through the printed circuit board and resiliently fitted thereto by means of soldering.

4. The junction component according to claim 1 wherein the base plate includes slits formed close to the connection part for increasing the resilience of the connection part.

5. The junction component according to claim 1 further comprising an arm protruding from the plane of the base plate, in a direction opposite a tab that is perpendicular to the base plate, for gripping the junction component by automated manufacturing equipment.

6. An electrically conducting junction component for connecting electrical leads of a printed circuit board and an electrical lead of a separate electrical unit, the junction component being resiliently fitted on the printed circuit board and comprising:

a base part having an integral base plate resiliently fitted in the printed circuit board and connected with a corresponding output of the printed circuit board; and a substantially flat connection part having a slot suitable for resiliently accepting the electrical lead protruding from the electrical unit, thereby breaking up an oxide layer on the surface of the lead, the orientation of the electrical leads being, where the connection is made, substantially perpendicular to the plane of the printed circuit board, the connection part including a clamping fork having resilient prongs protruding from the base plate and being disposed in a substantially parallel direction to the printed circuit board and defining between them the slot that accepts the electrical lead in a direction which is substantially perpendicular to the printed circuit board.

7. The junction component according to claim 6 wherein the clamping fork protrudes beyond the printed circuit board at its edge.

8. The junction component according to claim 6 wherein the printed circuit board includes an opening that is formed around the slot of the clamping fork.

9. The junction component according to claim 6 wherein the end portion of the slot that receives the electric lead is formed as an outwardly broadening space bordered by slant guiding surfaces.

10. The junction component according to claim 6 wherein an inner end of the slot includes a broadening hole.

11. The junction component according to claim 6 wherein an outer side of the prongs of the clamping fork includes notches close to the base plate for increasing the resilience of the prongs.

* * * * *